United States Patent [19]

Jenkins et al.

[11] Patent Number: 4,926,167

[45] Date of Patent: May 15, 1990

[54] INFORMATION DISPLAY APPARATUS

[75] Inventors: Stuart M. Jenkins, Bognor Regis; Terence J. Harvey, Southsea, both of England

[73] Assignee: Bright-Tech (Developments) Limited, England

[21] Appl. No.: 34,126

[22] Filed: Apr. 2, 1987

[30] Foreign Application Priority Data

Apr. 5, 1986 [GB] United Kingdom ..... 8608363

[51] Int. Cl.[5] ..... G09G 3/16

[52] U.S. Cl. ..... 340/764; 340/809; 340/783; 40/473; 40/505

[58] Field of Search ..... 340/764, 806, 783, 815.24, 340/815.26, 815.27, 815.29, 809; 40/423, 447, 449, 466, 497, 492, 473, 530, 531, 532, 533, 505

[56] References Cited

U.S. PATENT DOCUMENTS

| | | | |
|---|---|---|---|
| 1,765,215 | 6/1930 | Duchard . | |
| 3,199,098 | 8/1965 | Schwartz | 340/764 |
| 3,267,595 | 8/1965 | Levy et al. | 340/764 |
| 3,283,427 | 11/1966 | Winrow | 340/764 |
| 3,486,258 | 12/1969 | Mueller | 340/806 |
| 3,949,392 | 4/1976 | Caritato | 340/764 |
| 4,318,098 | 3/1982 | McGreevy | 340/806 |
| 4,566,003 | 1/1986 | Wakatake | 340/764 |
| 4,694,289 | 9/1987 | Kent | 340/783 |

FOREIGN PATENT DOCUMENTS

| | | |
|---|---|---|
| 2244322 | 3/1974 | Fed. Rep. of Germany . |
| 295989 | 11/1928 | United Kingdom . |
| 1023667 | 3/1966 | United Kingdom . |
| 1136324 | 12/1968 | United Kingdom . |
| 1165490 | 10/1969 | United Kingdom . |
| 1220338 | 1/1971 | United Kingdom . |
| 2101386 | 1/1983 | United Kingdom . |

OTHER PUBLICATIONS

*A Complete Guide to Heraldry;* A. C. Fox-Davies; 1978 Reprint of 1909 Edition; pp. 60, 132-3, 146-9, 532-3 & 572-3; Bonanza Books, New York.

*Primary Examiner*—Alvin Oberley

*Attorney, Agent, or Firm*—Panitch, Schwarze, Jacobs & Nadel

[57] ABSTRACT

An information display apparatus having a plurality of rotatable elements to create a changeable display of information is described. The display apparatus comprises a frame 1 in which are mounted a plurality of rotatable disc-shaped elements 4, each element having two display surfaces 5 and 6 and an array of activators 12. The frame of elements and the activators are moveable relative to one another. By selectively energising the activators 12, one or more of the elements 4 are rotated to alter the displayed information or image. The display apparatus may be arranged as a cylindrical of linear display. Sensors are positioned adjacent the activators (12) to sense the current position of the rotatable elements to decide if they need to be rotated.

8 Claims, 5 Drawing Sheets

INFORMATION DISPLAY APPARATUS

BACKGROUND OF THE INVENTION

1. Field of the Invention

This invention relates to information display apparatus and more particularly to visual information display apparatus.

2. Description of the Prior Art

Information display apparatus are known in which an image is formed by selectively displaying an appropriate face of one or more character forming elements. Electromagnetic means have been used to actuate the elements to change the image. Such display apparatus are of complex construction in that they require an electromagnet for each element.

SUMMARY OF THE INVENTION

An aim of the present invention is to reduce the number of activating means to provide a display apparatus of simplified and compact construction.

According to the present invention there is provided an information display apparatus comprising a frame in which are mounted a plurality of moveable elements having at least two display areas and an array of activating means, wherein the frame of elements and the array of activating means are moveable relative to each other such that on selective energisation of the activating means one or more of the plurality of elements is or are moved to create a changeable display of information.

Conveniently the frame of moveable elements is rotatable relative to the array of activating means.

The frame of elements may be arranged on a cylindrical surface which is rotatable with a fixed array of activating means. Alternatively the frame of elements can be arranged as a fixed linear surface which is traversed by the array of activating means.

Preferably the activating means comprises an array of electromagnets which are selectively energised.

In another construction the electromagnets control air jets which impinge on the plurality of elements to rotate one or more elements to display a changeable image.

The activating means are preferably microprocessor controlled to display changeable characters or images.

The sides of each frame are provided with a series of timing marks offset by a distance twice the width of the moveable elements.

BRIEF DESCRIPTION OF THE DRAWING

An embodiment of the invention will now be described, by way of example, with reference to the accompanying drawings, in which.

Figure 1:
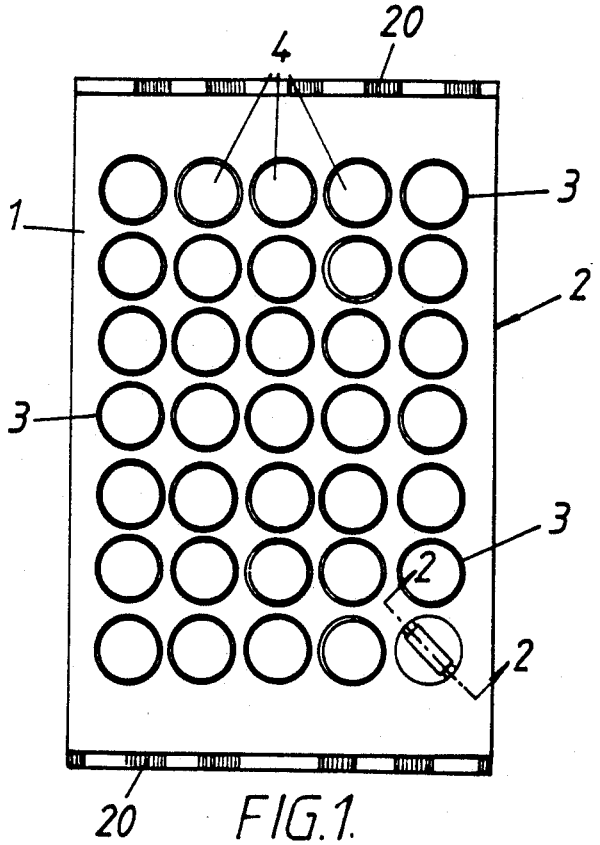
FIG. 1 is a front elevation of a display unit, according to the present invention.

The display apparatus comprises a frame 1 made up from one or more units generally indicated at 2. Each frame unit 2 is formed with a plurality of apertures 3 in which are rotatably mounted disc-shaped elements 4 each element having two display surfaces 5 and 6. These discs are made of a soft magnetic material and are each pivoted about two pins 7 located in bearings formed by recessed portions 8 in the frame.

Figure 2:
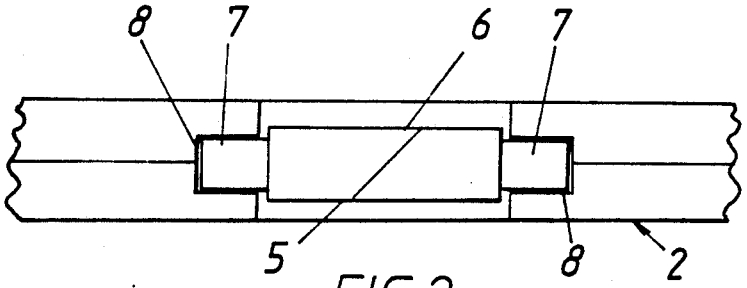
FIG. 2 is an enlarged cross-section taken along the line II—II of FIG. 1.
Figure 3:
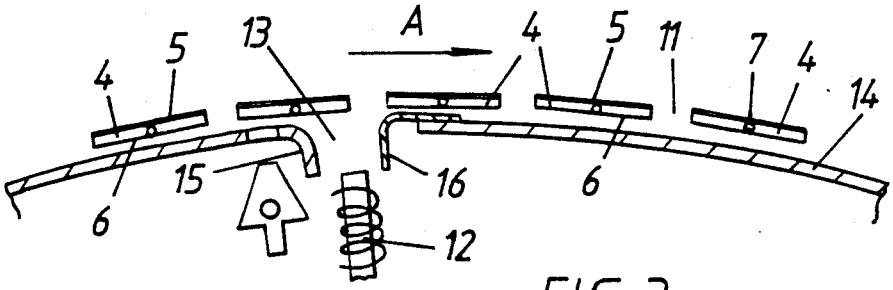
FIGS. 3 to 6 are diagrammatic views showing the movement of a cylindrical display relative to a fixed activating means.
Figure 4:
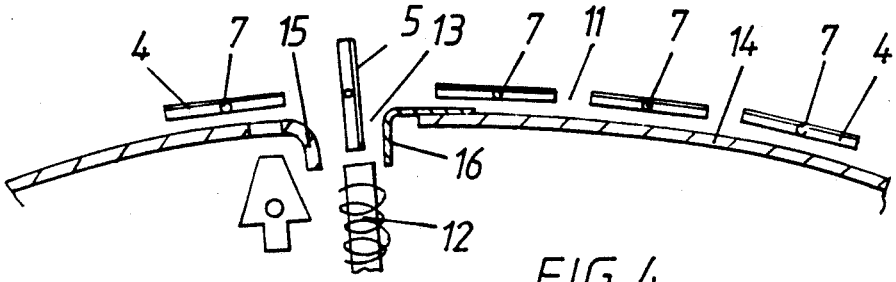
Figure 5:
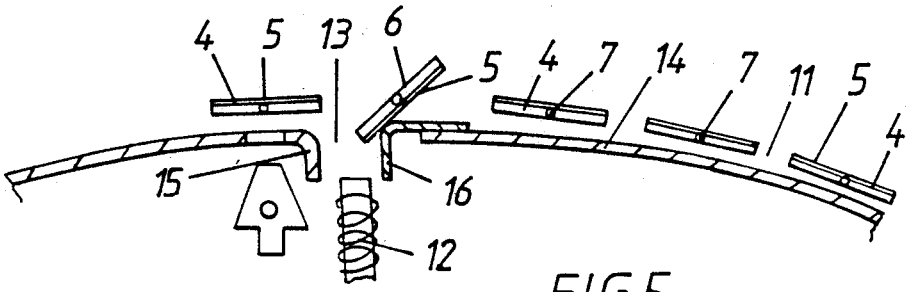
Figure 6:
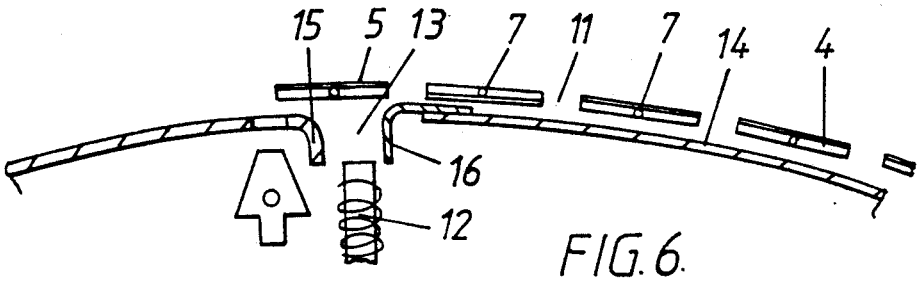

The frame unit 2 is made of a laminate of molded hard magnetic material of low magnetic remanence. As shown in FIG. 2, two recess bearing portions 8 are provided for location of the disc-shaped element pivot pins 7 in the magnetic frame unit 2. The laminate is of right-hand and left-hand construction.

Each disc-shaped element 4 has two contrasting surfaces which can be of a fluorescent sheet material, or coated with other suitable material such as paint. The discs are arranged to pivot about their pins along axes at 45 degrees to the sides of the frame units 2. The frames are thus divided along magnetic lines south pole-null-north pole-null-south pole etc. The combined magnetic effect of the laminate acts as a detent to maintain the alignment of the rotatable elements flat with the plane of the frame units, until the detent forces are overcome by actuating any of the electromagnets 12.

Arranged at the sides of each frame unit 2 are a series of timing marks 20 which are offset by a distance of twice the diameter of the disc-shaped elements 4.

With reference now to FIGS. 3 to 6 these illustrate a preferred construction of the invention in which the frame and elements are arranged as a cylinder 11 which is rotated by a motor (not shown) about an axis relative to a fixed activating means 12. The activating means comprises a vertical support which carries an array of seven electromagnets projecting into an aperture 13 formed in a fixed cylindrical wall 14 located inside cylindrical frame 11. One wall of the aperture 13 is rigid and is curved to provide a smooth guide 15 for each rotatable element 4 as it is attracted by an adjacent electromagnet and pivoted about its pins 7. The other wall of the aperture is provided with a curved flexible member 16 which eliminates the effect of extraneous stray magnetic influence and to gently urge the rotatable element attracted by the electromagnet over its 90 degree pivot point to display its other surface.

In operation the cylindrical frame 11 of rotatable display elements is rotated in the direction of arrow 'A' about an axis such that successive rows of elements pass adjacent to the array of electromagnets of the activating means 12. As each row of elements passes the aperture 13 in the wall into which the electromagnets project, the electromagnets are selectively energised to attract one or more rotatable elements and pivot them about their axis. The curved side 15 of the wall aperture guides the elements through 90 degrees until the resiliently flexible side wall 16 urges the element over its 90 degree position as it passes the activating means causing it to rotate through 180 degrees to display its other surface.

Figure 7:
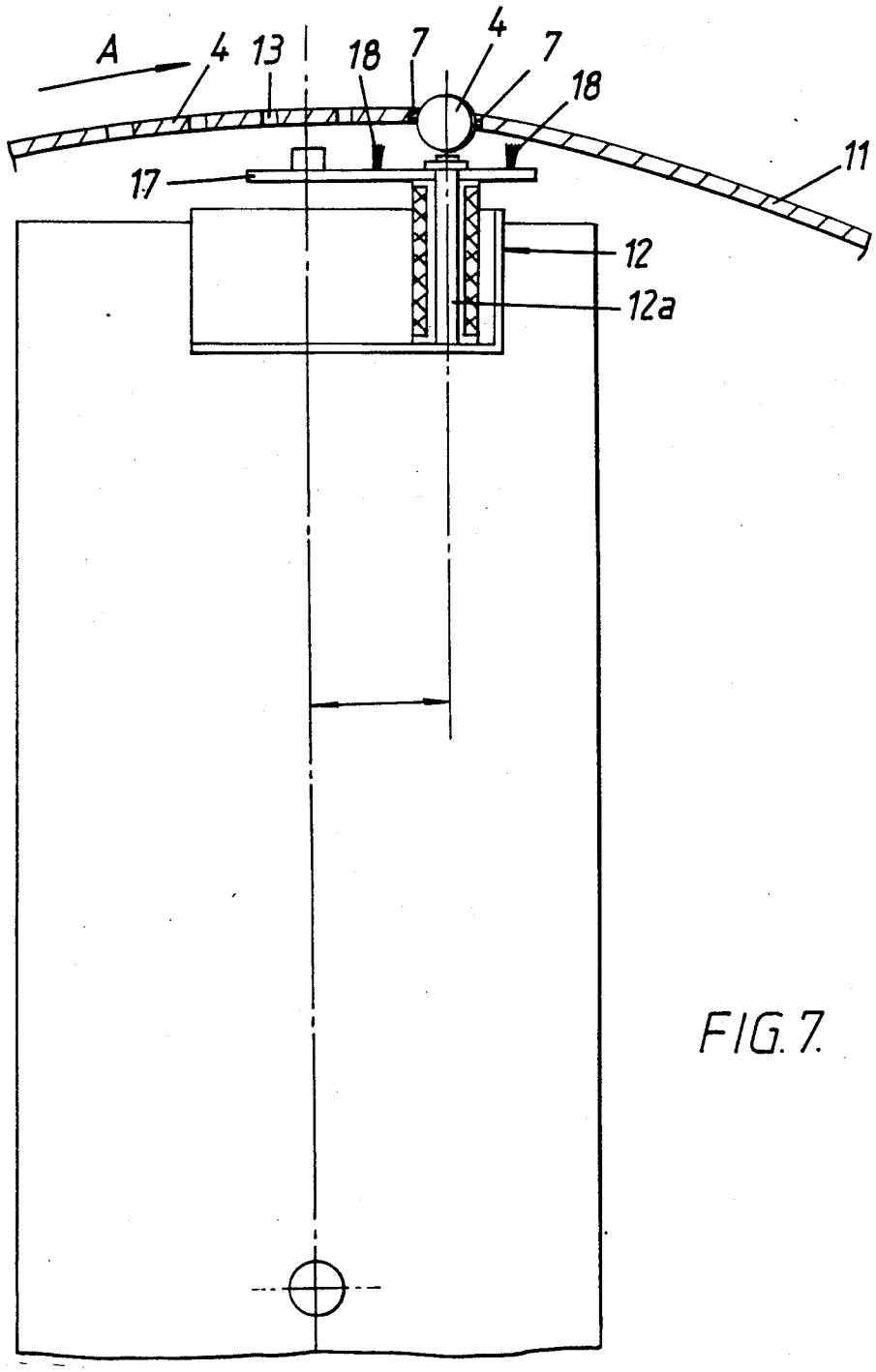
FIG. 7 is a modified diagrammatic view of the cylindrical display shown in FIGS. 3 to 6

In a modified construction of the cylindrical display illustrated in FIG. 7 the activating means takes the form of a vertical support 12 which carries an array of seven electromagnets **12*a* which are traversed by the cylindrical wall 11 made up of a plurality of frame units. Each frame unit is formed with circular apertures 13 in each of which is mounted a disc-shaped rotatable element 4. Located at one end of the electromagnets 12*a* is a printed circuit board 17**. Secured at each side of the electromagnets 12*a* is a brush 18 which engages the partially energised disc 4 and gently brushes them through 180 degrees to their reversed position. The brushes will minimise air flow over the elements to prevent the leading brush air flow disturbing the alignment.

Figure 8:
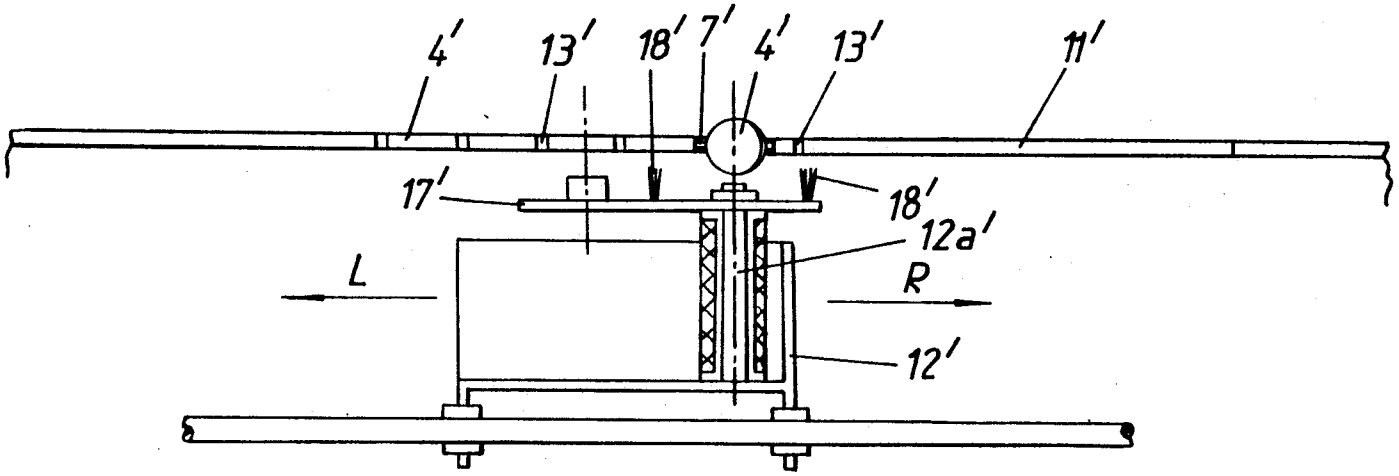
FIG. 8 is an alternative form of display showing a fixed linear housing with a reciprocating activating means.
Figure 9:
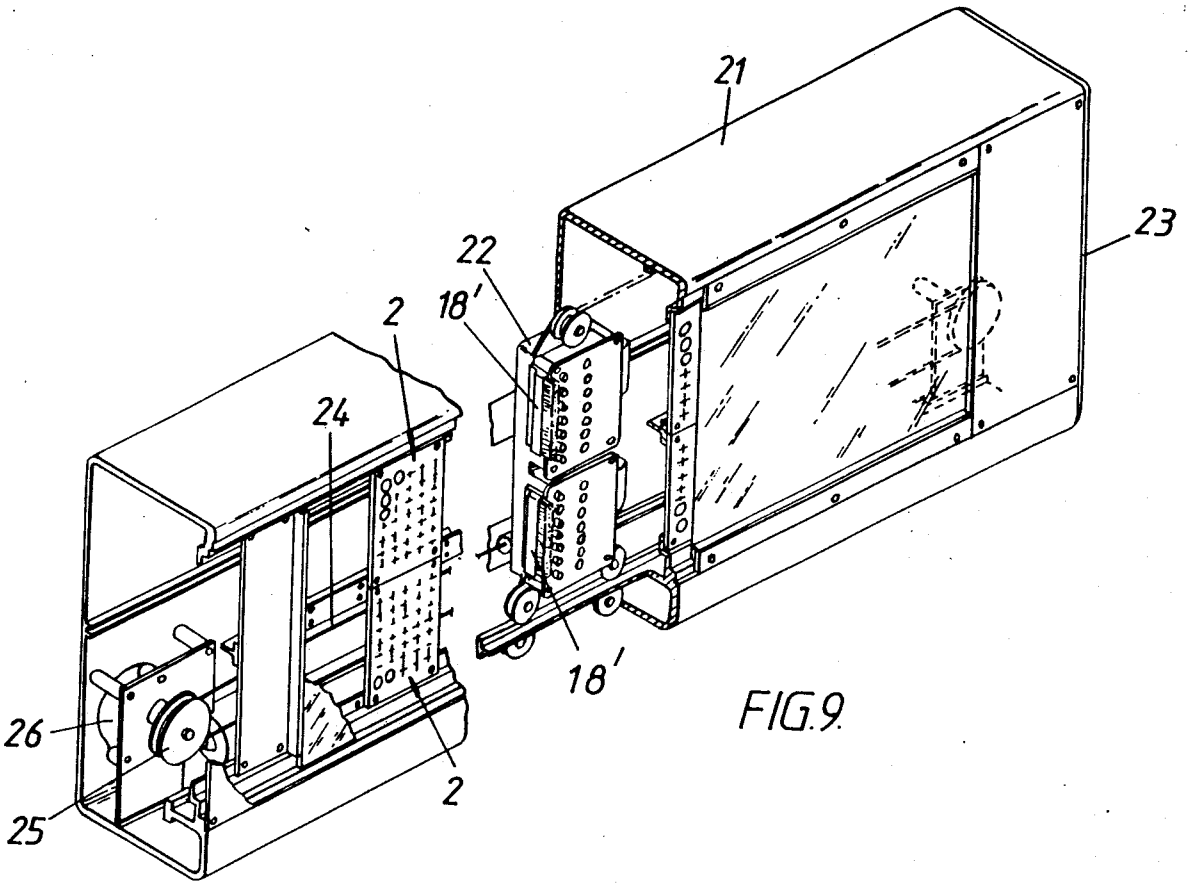
FIG. 9 is a perspective view with portions broken away, of the fixed linear housing of FIG. 8.

FIGS. 8 and 9 illustrate another embodiment of the information display apparatus comprising a fixed linear housing 21 with a reciprocating activating means 22. The housing 21 has an elongated rectangular cross-section with closing end plates 23. The front rectangular face of the display apparatus has an array of frame units 2 of the type illustrated in FIGS. 1 and 2.

Located within the housing 21 the activating means 22 reciprocates laterally along the array of fixed frame units 2. The activating means is illustrated on an enlarged scale in FIG. 8 and comprises a support 12' which carries a plurality of electromagnets 12*a*' which can be individually energised to attract selective ones of the magnetic discs 4' as it is traversed past them causing them to rotate through 180 degrees to show their reverse face and form an information display. The activating means is traversed along its linear path by a cable 24 and capstan 25 device, the capstan 25 being driven by an electric motor 26. A brush 18' is mounted on each side of the electromagnets 12*a* to engage the partially energised disc 4 to gently brush them through 180 degrees to their reverse position.

In a modified construction the cable and capstan device may be replaced by a toothed belt engaging a motor driven toothed wheel, providing a positive reciprocating motion to the energising means.

The array of frame units 2 form a two line display but this can be enlarged to more than two lines to provide a greater display area.

It will be appreciated that the arrangement and shape of the rotatable elements in the frame structure provide a display which can be rapidly changed to provide a variety of characters, designs or animated images.

The simplicity of having a single array of activating means to selectively alter the display reduces the cost and improves the operating efficiency of the display apparatus.

Although the preferred embodiment describes a cylindrical display surface moveable relative to a fixed actuating means, it is equally possible to provide a fixed display surface containing the rotatable elements, and move the activating means in close proximity to the rotatable elements to rotate them by selectively energising the electromagnets of the activating means.

One arrangement for driving the activating means causing them to traverse the display surface is to mount them on a support rod with a drive belt to pull the activating means to and fro along the display surface. Another method of moving the activating means along a linear path can be by means of a lead-screw which rotates and causes a nut on the lead-screw, which nut is fixed to the activating means, to move along the lead-screw to traverse the display surface selectively rotating the elements.

Although the energising means has been described as electromagnetic it is, of course, possible to use other forms of activation such as blasts of air controlled by electrically activated valves, which blasts would impinge on the rotatable elements to selectively rotate them about their axes.

The selective actuation of the electromagnetic means are preferably microprocessor controlled to provide a pre-programmed changing of the display. The programmed changing of the display can alternatively be under the control of a computer keyboard where characters on the display can be altered to display messages or urgent information.

An enhancement to the invention would be the provision of sensing means 15 (see FIGS. 7 and 8) to sense the current position of the rotatable elements. Such sensing means 15 would preferably be mounted adjacent to the activating means and arranged such that one sensor is provided for each horizontal row of rotatable elements. The relative movement of the activating means and sensing means 15, and the array of rotatable elements, would enable the status of all rotatable elements to be ascertained by the sensing means; the information so derived could then be used by the microprocessor to decide whether a given rotatable element needs to be rotated when setting up a new image on the display surface.

We claim:

1. An information display apparatus comprising a frame molded from a magnetic material of low remanence in which are mounted a plurality of movable elements rotatable relative to the frame and having at least two display areas, and an array of activating means comprising an array of selectively energized electromagnets and leading and trailing brushes to assist in the alignment of the moveable elements and to minimize air flow over the elements, to prevent the air flow from disturbing the alignment, wherein the frame of elements is arranged on a fixed linear surface which is traversed by the array of activating means, the frame of elements and the array of activating means being movable relative to one another such the selective energization of the activating means rotate one or more of the movable elements to create a changeable display of information.

2. An information display apparatus as claimed in claim 1 wherein the activating means are microprocessor controlled to display changeable characters or images.

3. An information display apparatus as claimed in claim 2 wherein an array of sensing elements corresponding to the actuation means are able to detect the state of the display elements in advance of actuation to correct errors arising in the display.

4. An information display apparatus comprising a frame in which are mounted a plurality of elements movable relative to the frame, each element having at least two contrasting display areas, and an array of microprocessor controlled activating means to display changeable characters or images, the array of activating means comprising an array of selectively energized electromagnets and an array of sensing elements corresponding to the activating means to detect the state of the display elements in advance of actuation to correct errors arising in the display, wherein the frame of elements is traversed by the array of activating means, and the frame of elements and the array of activating means being movable relative to one another such that selective energization of the activating means moves one or more of the movable elements to create a changeable display of information.

5. An information display apparatus as claimed in claim 4 wherein the movable elements are moulded from a soft magnetic material of low remanence.

6. An information display apparatus as claimed in claim 4 wherein a wall is located between the frame and the activating means, an aperture being provided in the wall, one side of the aperture having mechanical means to assist an adjacent row of elements to rotate.

7. An information display apparatus as claimed in claim 4, wherein mechanical means are provided on the array of activating means to assist alignment of the removal elements and to minimize airflow over the elements to prevent a leading one of the mechanical means from disturbing the alignment.

8. An information display apparatus as claimed in claim 7, wherein the mechanical means are leading and trailing brushes.

* * * * *